US005439101A

United States Patent [19]

Brink et al.

[11] Patent Number: 5,439,101

[45] Date of Patent: Aug. 8, 1995

[54] CONVERTIBLE ENVELOPE

[75] Inventors: Thomas J. Brink, Conover, N.C.; Jack B. Keable, Hiltonhead, S.C.

[73] Assignee: Waldorf Corporation, St. Paul, Minn.

[21] Appl. No.: 99,909

[22] Filed: Jul. 30, 1993

[51] Int. Cl.[6] ..... B65D 5/52

[52] U.S. Cl. ..... 206/45.24; 40/155; 40/156

[58] Field of Search ..... 40/155, 156, 152.1, 40/158.1; 206/45.24

[56] References Cited

U.S. PATENT DOCUMENTS

| | | | |
|---|---|---|---|
| 149,484 | 4/1874 | Kelly et al. . | |
| 587,660 | 8/1897 | Sackett . | |
| 754,201 | 3/1904 | Davalos . | |
| 917,938 | 4/1909 | Goodman . | |
| 918,093 | 4/1909 | Sales . | |
| 924,094 | 6/1909 | Myers . | |
| 1,114,596 | 10/1914 | Dustan . | |
| 1,515,901 | 11/1924 | Helmquest . | |
| 1,539,619 | 5/1925 | Wood . | |
| 1,632,185 | 6/1927 | Jenner | 40/152.1 X |
| 1,774,215 | 8/1930 | Weinthrop . | |
| 2,087,825 | 7/1937 | Vaughn . | |
| 2,219,492 | 10/1940 | Prichap | 40/152.1 |
| 2,219,526 | 10/1940 | McLaren . | |
| 2,281,452 | 4/1942 | Ottinger . | |
| 2,310,371 | 2/1943 | Lines et al. . | |
| 2,405,914 | 8/1946 | Van Rosen . | |
| 2,826,296 | 3/1958 | Mullinix . | |
| 2,845,733 | 8/1958 | Fox . | |
| 2,945,616 | 7/1960 | Normadin . | |
| 3,123,280 | 3/1964 | Currie . | |
| 3,174,244 | 3/1965 | Walton | 40/158.1 |
| 3,266,714 | 8/1966 | Heuberger | 40/152.1 X |
| 3,656,613 | 4/1972 | LaFrance et al. . | |
| 3,734,396 | 5/1973 | Cowan . | |
| 3,933,294 | 1/1976 | Meenan et al. . | |
| 3,966,113 | 6/1976 | Tipton . | |
| 4,014,434 | 3/1977 | Thyen . | |
| 4,109,850 | 8/1978 | Meenan et al. . | |
| 4,167,241 | 9/1979 | Zumbrunn | 40/152.1 |
| 4,275,517 | 6/1981 | Blanchard . | |
| 4,343,105 | 8/1982 | Isaacson . | |
| 4,765,485 | 8/1988 | Perkins . | |
| 4,780,975 | 11/1988 | Friedman . | |
| 4,991,767 | 2/1991 | Wyant . | |
| 5,038,503 | 8/1991 | Goldberg . | |
| 5,060,847 | 10/1991 | Angus . | |
| 5,123,589 | 6/1992 | Cote . | |

*Primary Examiner*—Bryon P. Gehman
*Attorney, Agent, or Firm*—Schwegman, Lundberg & Woessner

[57] ABSTRACT

The present invention is an envelope or shipping container, particularly adapted for shipping photographic material such as prints or the like. The envelope includes a front wall, a back wall, and a sealable closure flap provided with a tear strip for opening the envelope. The closure flap is adapted to be reshaped into a support, whereby the envelope may be converted to an easel for displaying the photographic materials previously contained therein, or other photographic materials. The back wall of the envelope is adapted to engage the closure flap and the front wall includes a plurality of mounting slots for receiving the material to be displayed on the easel.

26 Claims, 6 Drawing Sheets

CONVERTIBLE ENVELOPE

TECHNICAL FIELD

The present invention relates to convertible paperboard envelopes. More particularly, the present invention relates to a convertible paperboard mailing carton wherein the carton can be used to contain and transport display materials such as photographs, and can be adapted for forming a display support easel for displaying or viewing the material.

BACKGROUND OF THE INVENTION

Paperboard envelopes or containers, with interlocking tongue and slot features, for containing and mailing or transporting material are well known. U.S. Pat. No. 4,765,485 (to Perkins) discloses a paperboard mailing envelope having such an interlocking tongue and slot formed on the closure flap and on the back panel. The tongue and slot are adapted to interlock to prevent undetected opening. The Perkins envelope further discloses a tear strip to provide for opening the envelope. Although suitable for mailing or transporting items, the envelope disclosed by Perkins is not designed to be convertible to provide a means for displaying the items formerly contained therein after it has been opened.

U.S. Pat. No. 4,343,105 (to Isaacson) discloses a display device including an ordinary mailing envelope with a slot in the back. A stiff fibre-board card is inserted in the envelope, and includes a tab or tongue which is pushed outwardly through a slot in the back of the envelope to serve as a prop to support the envelope in a manner of a display card for counters or shelves in stores. While the Isaacson display device provides a stand for pictures, it may be difficult to manipulate the stiff planar member through the slot in the envelope, and the corners of the slot may tend to tear under the pressure imposed by the support member. Further, no provision is made for mounting or attaching material on the outside surface of the device.

U.S. Pat. No. 3,656,613 (to LaFrance et al.) discloses a folder for stranded material, such as tinsel or other strands. The folder has two main panels foldably connected, and side panels connected to each main panel to form pouches to hold the strands in position. The main panels may be folded upon themselves and sealed by a glue patch. For opening the folder, a tear strip is provided and a viewing window may be provided in one of the main panels so that the contents of the folder may be viewed without opening; however, in the viewing mode, the panels are spaced from one another at their free ends and not connected, and, therefore, do not provide the stability required for secure display of a picture or the like.

U.S. Pat. Nos. 1,515,901 (to Helmquest), 1,539,619 (to Wood), 2,310,371 (to Lines et al.), and 4,014,434 (to Thyen) respectively disclose a mount for displaying photographs, a somewhat similar mount, an envelope for containing photographic material with a tear strip opening feature, and a folder provided with means for locking the folder panels in the folder configuration. None of these four patents discloses or suggests a convertibility feature.

U.S. Pat. No. 4,780,975 (to Friedman) discloses a combined mailer and easel-type display frame for a blank. The Friedman mailer with easel requires three panels, one of which includes a brace panel with a tongue portion for engaging a slot in the lower panel to create a support easel. The brace panel is defined by multiple parallel sections with fold lines therebetween, but there is no disclosure of how to incorporate a tear strip opening feature for the mailer. Somewhat similarly, U.S. Pat. No. 2,845,733 (to Fox) discloses a combination envelope and easel for containing and/or framing pictures or the like. The Fox envelope and easel requires adhesive or gum connections between the flaps, which are manipulated to form the support portions for the easel. It does not disclose a tear strip to facilitate the opening of the envelope.

Accordingly, there is a need for a convertible mailing envelope for containing materials such as photographic prints, wherein the envelope may be opened easily and converted easily to provide an easel on which photographic prints or the like may be displayed for viewing.

SUMMARY OF THE INVENTION

The present invention is an envelope or shipping container, particularly adapted for shipping material such as photographic prints or the like and for displaying the contents after receipt. The envelope includes a front wall, or panel, a back wall, or panel, and a sealable closure flap provided with a tear strip for opening the envelope. The closure flap is adapted to be reshaped into a support, whereby the envelope may be converted to an easel for displaying the photographic materials previously contained therein. The back wall of the envelope is adapted to engage the convertible closure flap and the front wall includes means in the form of a plurality of mounting slots for receiving the material to be displayed on the easel.

To form the present invention into its envelope configuration, the front and back wall panels are overlaid .and the side edges are closed, leaving an opening extending along one edge of the envelope for receiving contents. Thus, the two panel envelope of the present invention (it has two main panels: the front and rear wall panels) embodies the typical thin, flat envelope shape. The opening is closeable by means of the sealable closure flap foldably connected to the front panel. In use, the envelope is filled and the closure panel folded along the fold line joining it to the front panel. A double-sided tape material seals the closure panel closed. The closure flap is provided with a tear strip and includes a plurality of scored fold lines, whereby the envelope may be opened and the closure flap formed into a support for converting the envelope an easel-like configuration. The closure flap has tabs which are received by slots cut into the back panel. Preferably, the closure flap may be folded into a "Z-shaped" configuration to support the converted envelope in a generally horizontal position, or in a generally vertical position. The front panel is provided with means in the form of a plurality of deflectable tab areas for receiving the corners of the item to be displayed.

The present invention encompasses embodiments wherein the prints or the like are displayed in a generally vertical position supported by the easel support formed from the closure flap, or wherein the prints or the like are displayed in a generally horizontal position raised at a slight angle above the horizontal by the easel support portions of the closure flap. The envelope of the present invention is preferably constructed from a single flat blank that may be folded and locked into the envelope configuration and then converted into the easel configuration. The blank may be formed from a suitable caliper of paperboard or other suitable material.

An object of the present invention is to provide a convertible envelope that can be reshaped into a display easel.

Another object of the present invention is to provide a sealable, yet easily opened, mailing container for photographic materials such as photographic prints that may be reclosed, or that may be converted to an easel for displaying the contents.

Yet another object of the present invention is to provide a convertible envelope, including an easily operable opening tear strip, wherein the envelope may be converted to an easel for displaying photographic prints in a generally vertical or horizontal position, and wherein the easel can be reconfigured as an envelope, and the envelope releaseably reclosed to store and protect the material formerly displayed on the easel configuration.

Advantages of the present invention include the provision of a convenient, convertible shipping container for prints or the like which can be converted to a temporary or permanent display and then reused as a storage container for the print if desired.

Other objects and advantages of the present invention will become more fully apparent and understood with reference to the following specification and to the appended drawings and claims.

DETAILED DESCRIPTION OF THE PREFERRED EMBODIMENT

Figure 1:
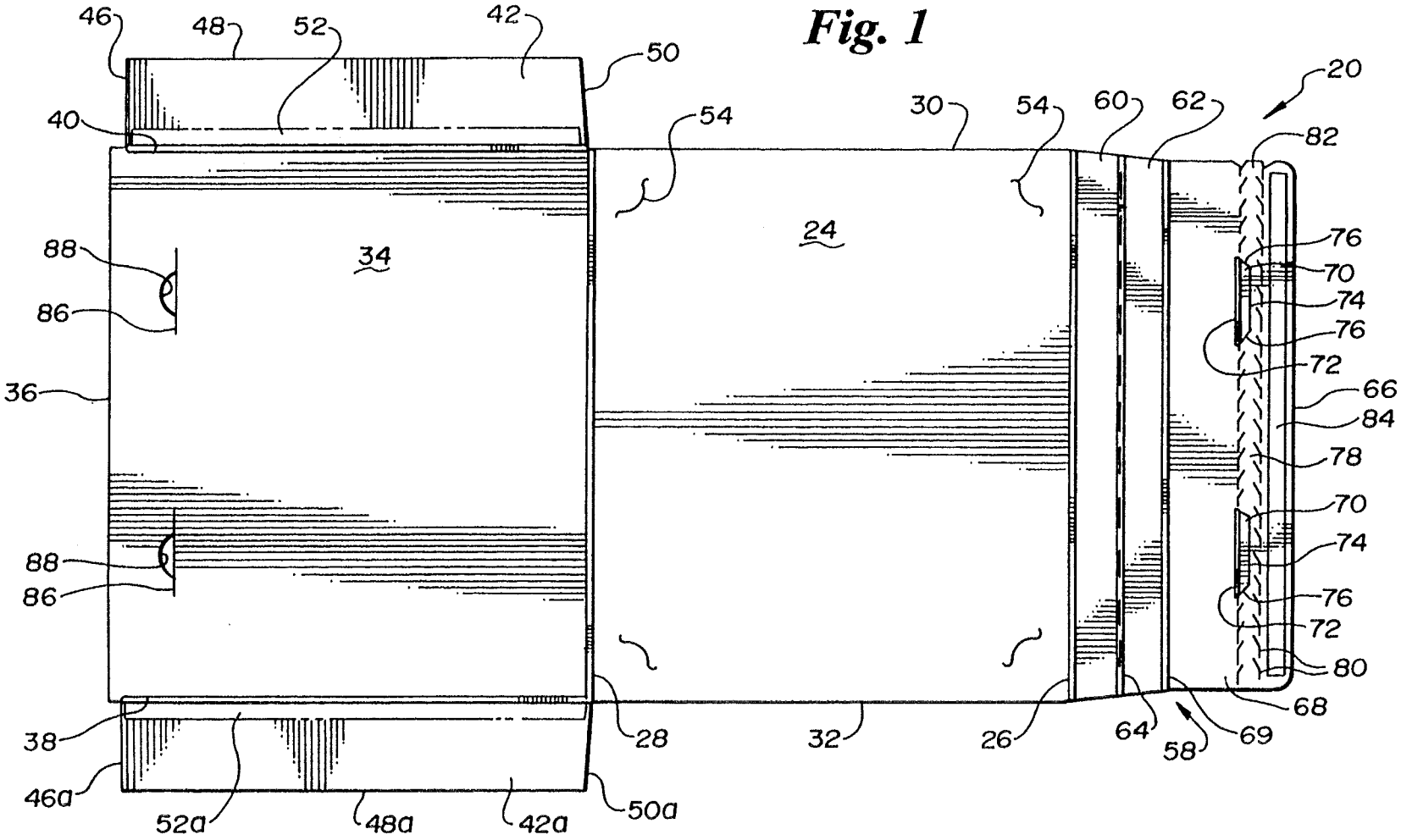
FIG. 1 is a plan view of the blank from which the envelope of the present invention may be formed, and shows the die-cut profile thereof.
Figure 5:
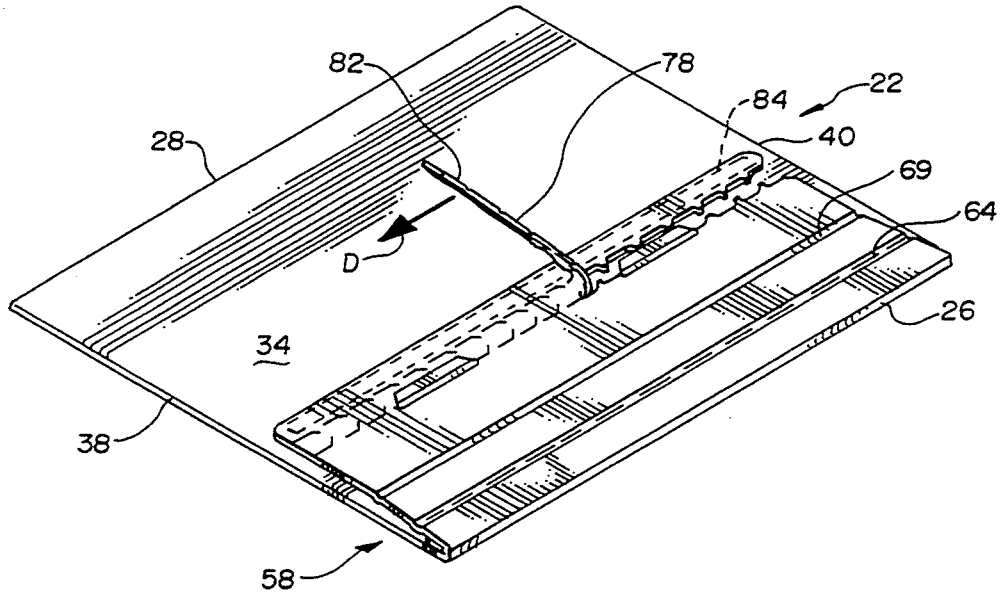
FIG. 5 is a perspective view of the present invention depicting the opening of the envelope.
Figure 6:
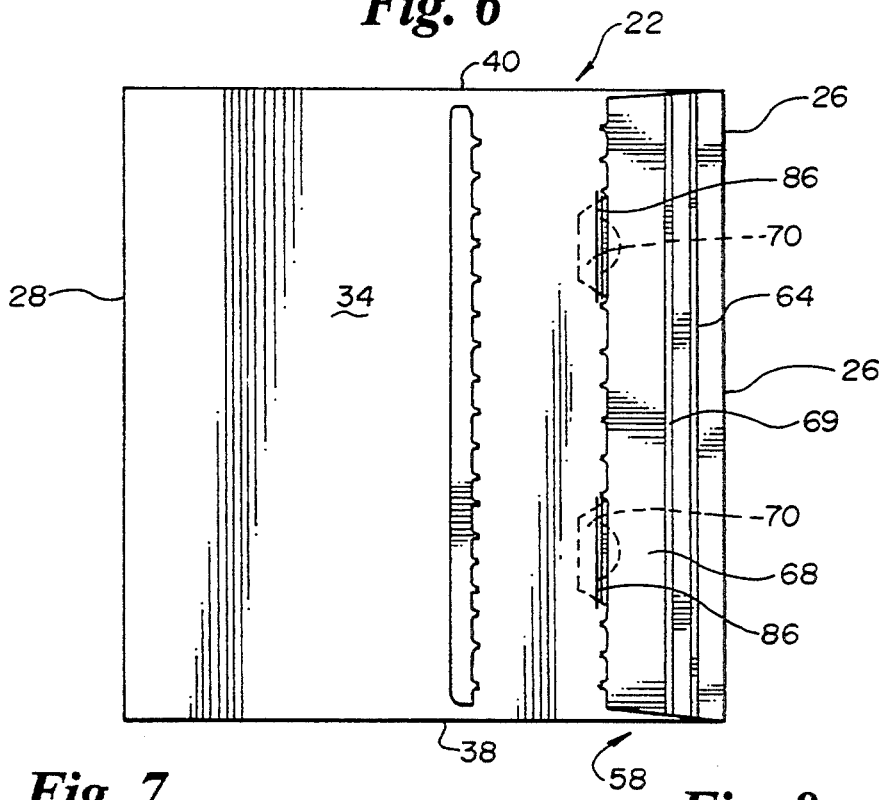
FIG. 6 is a plan view showing the envelope converted to an easel, with the easel support erected.

FIG. 1 depicts the inside surface of the blank 20 for forming, in accordance with the present invention, an envelope 22, depicted fully formed in FIG. 5. In the drawings, double lines indicate scores forming fold lines and single solid lines indicate cuts or free edges, except where otherwise indicated. Further, each panel, flap or tab of the envelope will include both in "inner" and an "outer" surface. The "inner" surface is that surface facing the inside of the envelope when assembled, while the "outer" surface is that surface facing the outside of the envelope when assembled.

The blank 20 has a generally rectangular front wall or panel 24 having two opposed pairs of edges defined by two parallel opposed fold lines 26, 28 and parallel free edges 30, 32. The panel 24 also includes inner and outer surfaces, the inner surface of which is shown in FIG. 1. A rear wall or panel 34 is foldably coupled to the front panel 24 along the fold line 28, and is further defined by a free edge 36 generally parallel to the fold line 28 and two opposed parallel fold lines 38, 40 generally perpendicular to the free edge 36 and fold line 28. The panel 34 also includes inner and outer surfaces, the surface of which is shown in FIG. 1. Although the panels 24 and 34 are referred to in the preferred embodiment as front and rear panels, respectively, they may also be considered as first and second panels.

A first side sealing flap 42 is foldably connected to the rear panel 34 along the fold line 40, and a second side sealing flap **42*a* is similarly connected to the back panel 34 along the fold line 38. The side sealing flaps 42, 42*a* are substantially identical, each having three remaining free edges 46, 48, 50 and 46*a*, 48*a* and 50*a*, respectively. Each sealing panel carries an adhesive region, 52 and 52*a*, respectively. Adhesive regions 52 and 52*a*** may comprise previously applied adhesive for later activation or a contact-type adhesive.

The front panel 24 is provided with a plurality of mounting cuts 54. The cuts 54 are depicted in FIG. 1, one being generally adjacent to each corner of the front panel 24, but more or fewer cuts 54 may be provided. For example, rather than two cuts 54 provided adjacent to the corners at the ends of the fold line 28, a single similar cut (not shown) adjacent to and generally centered between the ends of the fold line 28 may be provided. The cuts 54 comprise smoothly curved, continuous cuts in the front panel 24, generally tending to span the angles of the corners of the front panel 24 formed by the intersection of the fold lines 26, 28 and the free edges 30, 32. Further, means other than a plurality of slots or mounting cuts may be provided for mounting the photograph or the like to the front panel. For example, the photograph may embody means for such mounting.

With continued reference to FIG. 1, the blank 20 includes a sealing and support panel assembly 58. The assembly 58 is foldably connected to the front panel along the fold line 26 and includes a first supporting foot panel 60 immediately adjacent to the fold line 26 and coextensive with the length of the fold line 26. A second foot supporting panel 62 is immediately adjacent to the first panel 60, being separated therefrom by a perforated or cut fold score line 64, the scored fold line 64 being generally parallel to the fold line 26. Progressively outwardly from the fold line 26, toward the free edge 66 of the sealing and support assembly 58, the assembly 58 includes a tab panel 68. The tab panel 68 is foldably connected to the second foot panel 62 along a fold line 69, is wider than the two foot support panels 60, 62, and carries at least a pair of spaced tabs 70. Each of the tabs 70 is formed by a tab base fold line 72 and a parallel tuck cut line 74 continuously connected to the ends of the scored fold line 72 by angled cuts 76. The two tabs 70 are substantially identical and, thus, are referenced using the same numbers. As illustrated, the combined width of the first and second foot panels 60 and 62 and the tab panel 68, between the fold line 26 and the fold line 72, is less than the dimension of the front panel 24 between the fold lines 28 and 26.

The tabs 70 taper and extend outwardly toward the free edge 66 of the assembly 58, i.e., the tuck line 74 is shorter than the fold line 72. The tabs 70 protrude into a tear strip 78 extending across the entire length of the sealing and support assembly 58. The strip 78 is defined by two parallel series of a plurality of in-line cuts 80, and includes at least one grasping tab 82 at one end. However, both ends of the tear strip 78 could be provided with such a tab 82. Between the tear strip 78 and the free edge 66, the inner surface of the sealing and support assembly carries an adhesive region 84. The adhesive region, as in the adhesive regions 52, 52*a*, can comprise a contact adhesive or an activatable adhesive, or, in the preferred embodiment, it may comprise a double-sided tape.

The tabs 70 are designed to be received in corresponding tab receiving slits 86 formed in the back panel 34. Each slit 86 includes a finger-receiving relieved area 88 adjacent thereto to facilitate the partial deflection of the back panel 34 in the region of the slit 86 so that the tabs 70 can be received therein.

Figure 2:
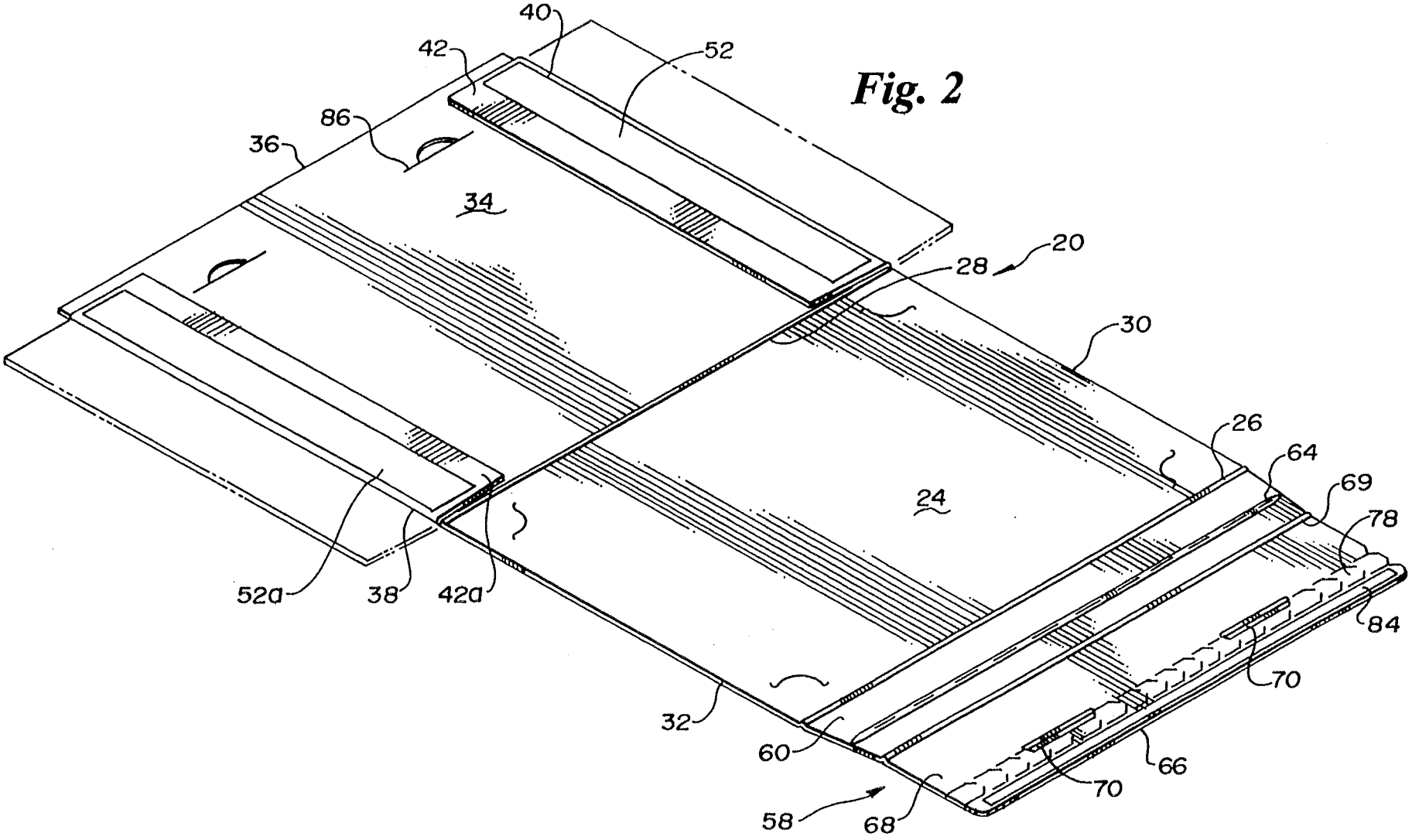
FIG. 2 is a perspective view of the present invention showing an initial step in the fold-up of the envelope of the present invention.
Figure 3:
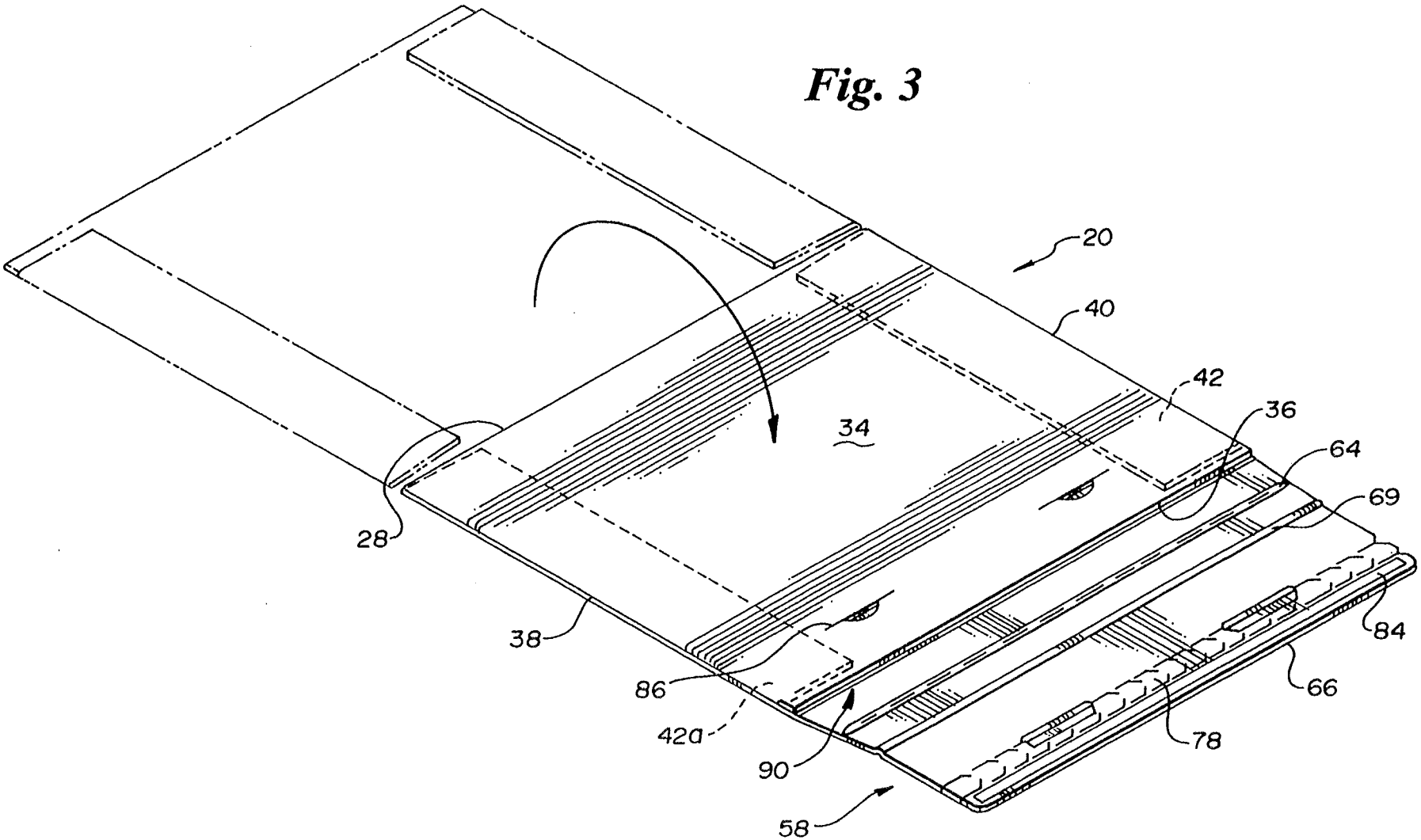
FIG. 3 is a perspective view of showing a subsequent step in forming the envelope of the present invention.
Figure 4:
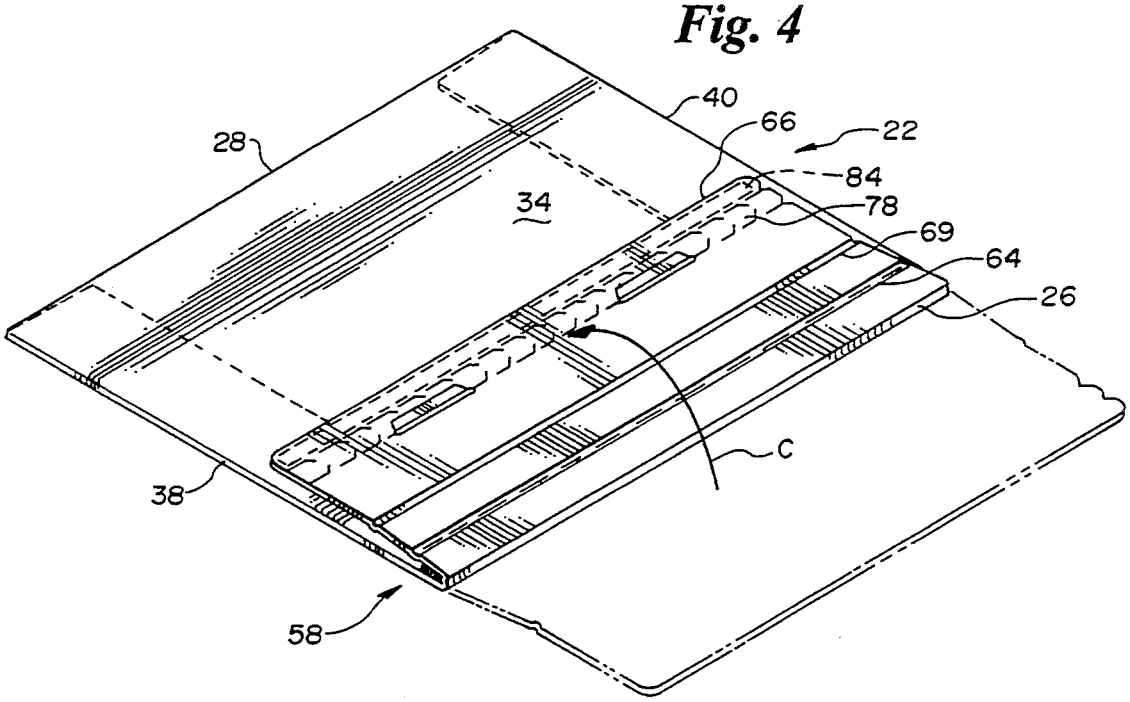
FIG. 4 is a perspective view showing the closure of the envelope for use as a shipment container.

FIGS. 2 and 3 depict the folding up or erection sequence of the blank 20 for forming the completed envelope 22 (depicted in FIGS. 4 and 5). First, 180 degree folds are made at fold lines 38, 40, whereby the side sealing flaps 42, 42a overlie the rear panel 34. As depicted in FIG. 2, this exposes or reveals the adhesive regions 52, 52*a* carried by the side sealing flaps 42, 42*a*.

FIG. 3 depicts a subsequent step in the fold up sequence. Specifically, the rear panel 34, including the sealing flaps 42, 42*a* carried thereby, are folded along fold line 28 into overlying relationship with the remainder of the envelope blank 20. The previously applied adhesive in the adhesive regions 52, 52*a* may then be activated or, if it is a contact type adhesive, the blank 20 will be fixed in the alignment and condition substantially that of an open envelope, depicted in FIG. 3. FIG. 3 also shows that the envelope 22 includes an opening, indicated generally at 90, whereby contents may be inserted.

FIG. 4 depicts the sealing of the envelope 22 after contents have been inserted. Specifically, the sealing and support panel assembly 58 is folded in the direction of arrow C 180 degrees along the fold line 26 until it overlies the outside of the rear panel 34. Prior to folding the sealing assembly 58 in this manner, the release layer covering the adhesive in the adhesive region 84 adjacent to the free end 66 of the sealing assembly 58 may be moved so that the sealing panel assembly 58 adheres to the rear panel 34, sealing the envelope 22.

FIG. 5 depicts the opening of the envelope 22 of the present invention. A recipient grasps the tab 82 at the end of the tear strip 78 and pulls in the direction of arrow D until the tear strip 78 is entirely removed from the envelope 22. Naturally, the portion of the sealing panel assembly 58 carrying adhesive remains adhered to the rear wall 34 of the envelope, while the remainder of the assembly 58 is free to foldably rotate about the fold line 26 so that the contents of the envelope 22 may be removed therefrom.

Figure 7:
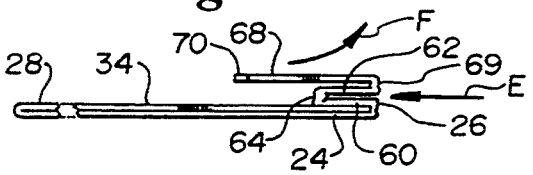
FIG. 7 is a side elevational view showing the manipulation of the sealing assembly to form the easel support.
Figure 8:
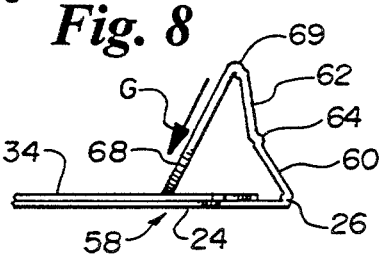
FIG. 8 is an elevational view depicting another step in the erection of the easel support.
Figure 9:
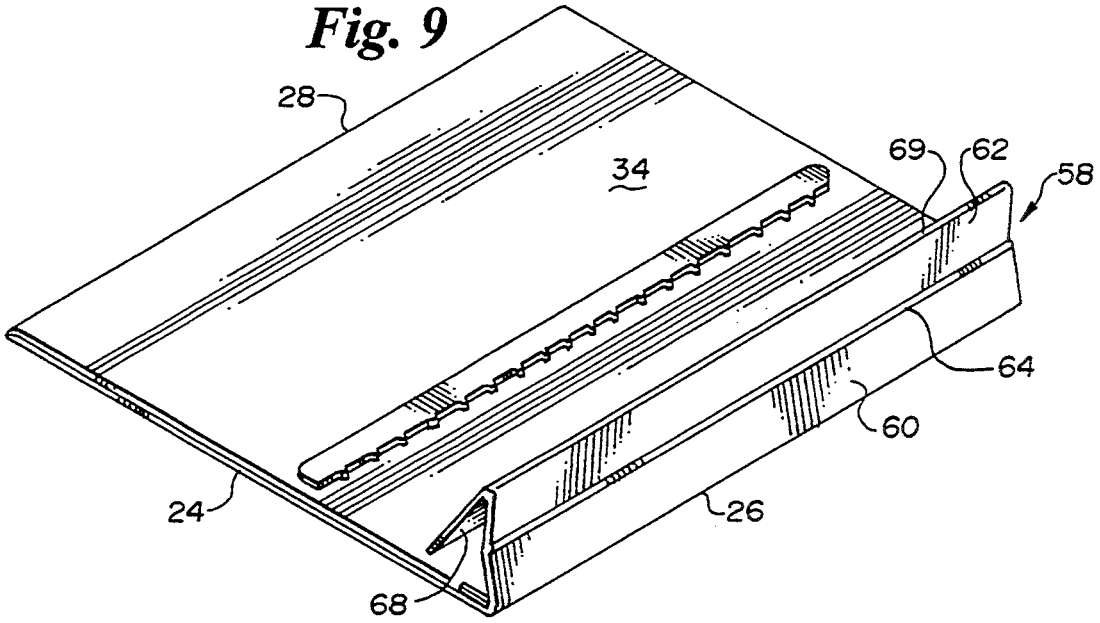
FIG. 9 is a perspective view of the present invention depicting the envelope fully converted to the easel of the present invention.
Figure 10:
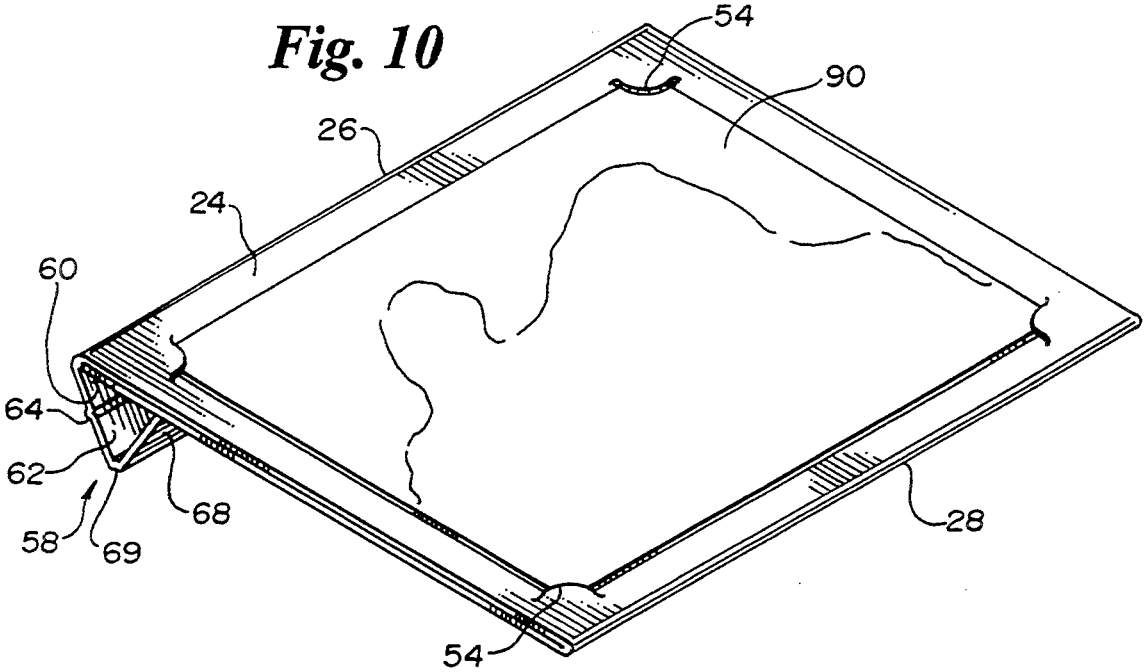
FIG. 10 is a perspective view of the envelope converted to an easel in a generally horizontal desktop position with a print displayed.
Figure 11:
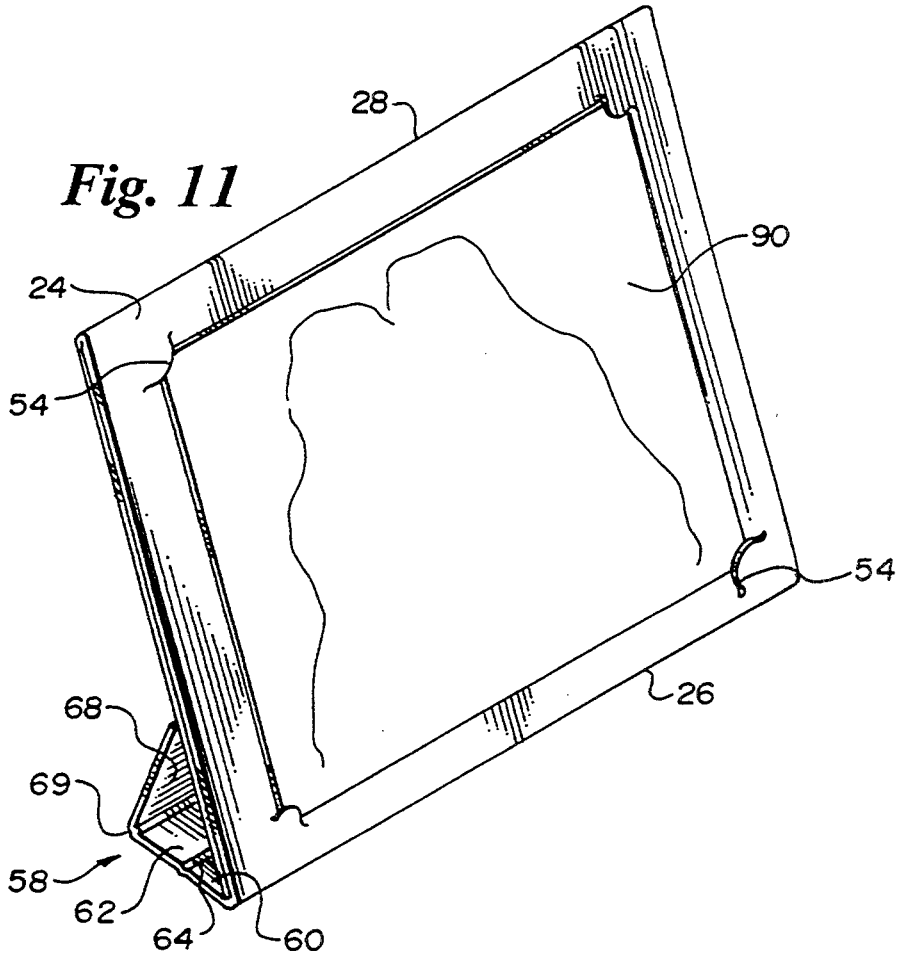
FIG. 11 is a perspective view of the present invention fully converted to an easel, with the easel in a generally vertical position.

FIGS. 6–9 depict the conversion of the envelope 22 into an easel as shown in FIGS. 10 and 11. After opening the envelope 22 and removing the contents, the sealing and support panel assembly 58 may be manipulated as shown in FIGS. 7 and 8. A folding force in the direction of arrow E (FIG. 7), and against fold line 64, causes the fold line 64 to move in the direction of fold line 28, bringing the foot panels 60, 62 into closely adjacent generally parallel relation. The tab panel 68 is folded generally downwardly about the fold line 69 in the direction of the rear panel 34 and then pushed in the direction of arrow F to bring the two tabs 70 into proximity with the two slits 86 in the rear wall panel 34. Exerting a force in the direction of arrow G (FIG. 8) causes the tabs 70 to enter the slits 86 and the sealing and support panel assembly 58 to assume the generally triangular support configuration depicted in FIGS. 8 and 9. The unfolding tendencies of the fold line 64 makes the panel assembly 58 tend toward its triangular shape, thereby strengthening the support formed by the panel assembly 58. These forces help keep the tabs 70 lodged within the slits 86.

As shown best in FIGS. 7 and 8, the score lines 26 and 69 are inside fold or score lines which facilitate the folding of their adjacent panels 24, 60 and 62, 68 inwardly such that their inner surfaces fold toward one another. In contrast, the fold or score line 64 is an outside score line which facilitates the folding of the adjacent panels 60, 62 outwardly such that their outer surfaces fold toward one another.

FIGS. 10 and 11 depict the present invention in its easel configuration. Specifically, in FIG. 10 a display item 90, the corners of which have been received in the deflectable mounting tab areas 54 associated with the front panel 24, is displayed and supported by the easel in a generally horizontal configuration. In this position, the easel rests substantially on the elongated edges formed by fold line 28 and fold line 69. FIG. 11 shows the easel in its generally vertical display position, again displaying an item 90. In this generally vertical position, the easel rests on the edges formed by fold lines 69 and 26. In either position, the tab panel 68 acts as a prop, providing significant support for the display surface of the easel. The easel is very stable because the points of contact with the surface upon which the easel is resting are along the length of the fold lines, rather than at a single point or a short line. The support assembly 58 also exhibits substantial rigidity because the natural resiliency of the paperboard and the unfolding tendencies at the fold line 64 tend to keep the tabs 70 in place.

The present invention could be changed by modifying its shape generally, or by changing the shape of the tabs 70 or tab receiving slits 86. Similarly, the shape of the mounting tab cuts 54 could be changed. Of course, the convertible envelope, and its easel configuration, may be provided with graphics, instructional indicia, or overwrapping as deemed appropriate.

Although a description of the preferred embodiment has been presented, various changes including those mentioned above could be made without deviating from the spirit of the present invention. It is desired, therefore, that the description be considered as illustrative, not restrictive and that reference be made to the appended claims to indicate the scope of the invention.

What is claimed is:

1. A convertible envelope comprising:

a first panel having a plurality of connection edges and a flap edge;

a second panel having a plurality of connection edges and a free edge;

a closure flap foldably connected to said first panel along said flap edge, said closure flap including a free edge spaced from said flap edge, at least one tab formed between said flap edge and said closure flap free edge and seal means between said tab and said closure flap free edge for connecting said closure flap to said second panel;

a tab receiving slot in said second panel to receive said tab; and means on said first panel for mounting display materials.

2. The envelope of claim 1 wherein said seal means includes an adhesive region.

3. The envelope of claim 1 wherein said first and second panels are connected to each other along their respective connection edges.

4. The envelope of claim 1 wherein said closure flap includes a base panel portion foldably connected to said first panel along said flap edge and a support panel portion foldably connected to said base panel portion along a support panel fold line.

5. A convertible envelope comprising:

a first panel having a plurality of connection edges and a flap edge;

a second panel having a plurality of connection edges and a free edge;

a closure flap foldably connected to said first panel along said flap edge, said closure flap including a free edge spaced from said flap edge, at least one tab formed between said flap edge and said closure flap free edge and seal means between said tab and said closure flap free edge for connecting said closure flap to said second panel, said seal means including an adhesive region and a removable tear strip between said adhesive region and said tab; and a tab receiving slot in said second panel to receive said tab.

6. The envelope of claim 5 wherein said tab is formed within said tear strip.

7. The envelope of claim 6 including a pair of tabs and a pair of tab receiving slots.

8. The envelope of claim 5 wherein said first and second panels are connected to each other along their respective connection edges.

9. The envelope of claim 5 being a two-panel convertible envelope.

10. The envelope of claim 5 wherein said closure flap includes a base panel portion foldably connected to said first panel along said flap edge and a support panel portion foldably connected to said base panel portion along a support panel fold line.

11. The envelope of claim 10 wherein said base panel portion includes first and second foot portions foldably connected to each other along a fold line generally parallel to said flap edge.

12. The envelope of claim 11 including inner score lines along said flap edge and said support panel fold line and an outer score line along said fold line between said first and second foot portions.

13. The envelope of claim 5 including means on said first panel for mounting display materials.

14. The envelope of claim 5 wherein said first and second panels are from and rear panels, respectively.

15. A convertible envelope comprising;

a first panel having a plurality of connection edges and a flap edge;

a second panel having a plurality of connection edges and a free edge;

a closure flap foldably connected to said first panel along said flap edge, said closure flap including a free edge spaced from said flap edge, at least one tab formed between said flap edge and said closure flap free edge and seal means between said tab and said closure flap free edge for connecting said closure flap to said second panel, said closure flap including a base panel portion foldably connected to said first panel along said flap edge and a support panel portion foldably connected to said base panel portion along a support panel fold line, wherein said base panel portion includes first and second foot portions foldably connected to each other along a fold line generally parallel to said flap edge; and a tab receiving slot in said second panel to receive said tab.

16. The envelope of claim 15 including inner score lines along said flap edge and said support panel fold line and an outer score line along said fold line between said first and second foot portions.

17. The envelope according to claim 15 including means on said first panel for mounting display materials.

18. A blank for forming a convertible envelope comprising:

a first panel having a plurality of connection edges and a flap edge;

a second panel having a plurality of connection edges and a free edge;

a closure flap foldably connected to said first panel along said flap edge, said closure flap including a free edge spaced from said flap edge, at least one tab formed between said flap edge and said closure flap free edge and seal means between said tab and said closure flap free edge for connecting said closure flap to said second panel, wherein said seal means includes an adhesive region and a removable tear strip generally between said adhesive region and said tab; and at least one tab receiving slot in said second panel to receive said at least one tab.

19. The blank according to claim 18, wherein said closure flap includes a base panel portion foldably connected to said first panel along said flap edge and a support panel portion foldably connected to said base panel portion along a support panel fold line.

20. The blank according to claim 18 including means on said first panel for mounting display materials.

21. A convertible envelope comprising:

a first wall and a second wall foldably connected to the first wall, each of said walls having side edges and each being generally parallel with respect to the other, the side edges being connected by side edge sealing flaps foldably carried by one of the first and second walls; and a closure flap assembly foldably connected to one of the first and second walls and having a free edge, said closure flap comprising a plurality of foldably interconnected parallel panels including two support panels and a tab panel, a removable tear strip, and an adhesive region between the tear strip and the free edge, whereby the closure flap assembly can be releaseably secured to the opposite one of the first and second walls, the closure flap assembly carrying at least one tab adjacent to the tear strip.

22. The envelope according to claim 21, wherein one of the first and second walls includes a slot to receive said at least one tab.

23. The envelope according to claim 21, said closure flap being foldably convertible to a support for supporting the first and second walls in a selected position after said tear strip is removed.

24. The envelope according to claim 23, wherein the one of the first and second walls to which the closure flap is attached includes a slot to receive said at least one tab to lock the support.

25. The envelope according to claim 24 including means on said first panel for mounting display materials.

26. The envelope according to claim 21 including means on said first panel for mounting display materials.

* * * * *

UNITED STATES PATENT AND TRADEMARK OFFICE

CERTIFICATE OF CORRECTION

PATENT NO. : 5,439,101

DATED : August 8, 1995

INVENTOR(S) : Brink et al.

It is certified that error appears in the above-identified patent and that said Letters Patent is hereby corrected as shown below:

Column 7 Line 58 "from" should read --front-- therefor.

Signed and Sealed this

Fourth Day of November, 1997

*Attest:*

*Attesting Officer*

BRUCE LEHMAN

*Commissioner of Patents and Trademarks*